US008201975B1

(12) United States Patent
Chen et al.

(10) Patent No.: US 8,201,975 B1
(45) Date of Patent: Jun. 19, 2012

(54) LED LIGHTING FIXTURE WITH ROTATING TERMINAL BLOCK

(75) Inventors: Yi-Yi Chen, Tainan (TW); Jen-Feng Huang, Kaohsiung (TW); Kai-Ren Syue, Kaohsiung (TW)

(73) Assignees: Innovative & Superior Technology Inc., Tainan (TW); Yi-Yi Chen, Tainan (TW)

( * ) Notice: Subject to any disclaimer, the term of this patent is extended or adjusted under 35 U.S.C. 154(b) by 0 days.

(21) Appl. No.: 13/034,997

(22) Filed: Feb. 25, 2011

(51) Int. Cl.
*F21V 21/26* (2006.01)

(52) U.S. Cl. ..... 362/269; 362/382; 362/418; 362/427

(58) Field of Classification Search ..... 362/89, 362/90, 170, 177, 197, 227, 230, 231, 239–241, 362/249.01–249.03, 249.07, 249.1, 249.11, 362/269, 277, 282, 285, 287, 310, 311.01, 362/311.02, 319, 322, 326–329, 365, 371, 362/372, 393, 410, 413, 414, 417, 418, 427, 362/429–431, 449, 800
See application file for complete search history.

(56) References Cited

U.S. PATENT DOCUMENTS 3,736,417 A * 5/1973 Williams ..... 362/430
7,338,181 B2 * 3/2008 Yuen ..... 362/96
7,390,110 B2 * 6/2008 Katz et al. ..... 362/382

* cited by examiner

*Primary Examiner* — Hargobind S Sawhney
(74) *Attorney, Agent, or Firm* — Rosenberg, Klein & Lee

(57) ABSTRACT

A LED lighting fixture with a rotating terminal block is revealed. The LED lighting fixture includes a housing with a connection hole on one end. Positioning teeth are arranged at an inner edge of the connection hole and a rotating shaft sleeve with a stop flange against the connection hole is mounted in the connection hole. Moreover, positioning teeth corresponding to the positioning teeth of the connection hole are disposed on an inner side of the stop flange. A threaded segment threaded with a terminal block for connection and positioning is set on an outer edge of the rotating shaft sleeve. Thus the housing can be rotated directly and the positioning teeth of the housing and the positioning teeth of the rotating shaft sleeve are engaged and locked with each other so as to make the housing rotate around the terminal block. Therefore, the lighting angle is adjusted optimally.

2 Claims, 7 Drawing Sheets

LED LIGHTING FIXTURE WITH ROTATING TERMINAL BLOCK

BACKGROUND OF THE INVENTION

1. Field of the Invention

The present invention relates to a LED lighting fixture, especially to a LED lighting fixture with a rotating terminal block whose lighting angle is adjustable. Thus the LED lighting fixture with a rotating terminal block has a higher practical value in applications.

2. Description of Related Art

Since the development of light emitting diode (LED), it has been used broadly in various applications. The LED features on high luminous efficiency and lower power consumption. At the same input power, the LED luminous efficiency is several times than that of other lights. Under the same lighting effects, the power consumption of LED is far more less than others. Various companies are dedicated to improving the LED with higher efficiency for more applications and reducing energy consumption. Thus users can save their electricity expenses.

Generally, LED lighting fixtures include housings mounted with lighting components therein. The lighting components are lighting sources with LED. A terminal block for connection with a light holder is fixed on one end of the housing. Through the light holder and the terminal block, the lighting components in the housing get power and emit light.

The above LED lighting fixture can be threaded with the light holder to get power and emit light. In practice, it is found that the LED lighting fixture is connected to the light holder by the terminal block that is fixed on the housing. Moreover, the light output of the LED lighting fixture is linear, toward a single direction. Thus the LED light is not projected to the required position after the LED lighting fixture threaded with the light holder by the terminal block. Now the LED lighting fixture needs to be rotated a bit so as to make the lighting surface faces the required position. However, the rotated LED lighting fixture is not positioned and is easy to rotate or wobble again due to gravity or contact. This not only brings inconvenience in applications. The rotated LED lighting fixture may fail to light due to poor contact, or even more have short circuit and generate sparks caused by wobble.

Thus there is a need to improve the structure of the LED lighting fixture available now.

SUMMARY OF THE INVENTION

Therefore it is a primary object of the present invention to provide a LED lighting fixture with a rotating terminal block in which the angle of a light emitting surface of lighting components in the LED lighting fixture can be adjusted and changed so as to increase the practical value and convenience of the device.

In order to achieve the above object, a LED lighting fixture with a rotating terminal block of the present invention includes a housing with a connection hole on one end thereof. A plurality of positioning teeth is arranged at an inner edge of the connection hole and a rotating shaft sleeve is mounted in the connection hole. A stop flange for against the inner side of the connection hole is disposed on an inner end of the rotating shaft sleeve. Moreover, positioning teeth corresponding to the positioning teeth on the inner edge of the connection hole are disposed on the inner side of the stop flange while a threaded segment is set on an outer edge of the rotating shaft sleeve. The threaded segment is threaded with a terminal block for connection and positioning. Thus the housing can be rotated directly and the rotation between the housing and the rotating shaft sleeve occurs. During the rotation, the positioning teeth of the housing and the positioning teeth of the rotating shaft sleeve are engaged and locked with each other so that the housing is able to be rotated and adjusted around the terminal block that is threaded and connected with an outer edge of the threaded segment of the rotating shaft sleeve. Therefore, the angle of the light emitting surface of lighting components in the housing is adjusted optimally.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
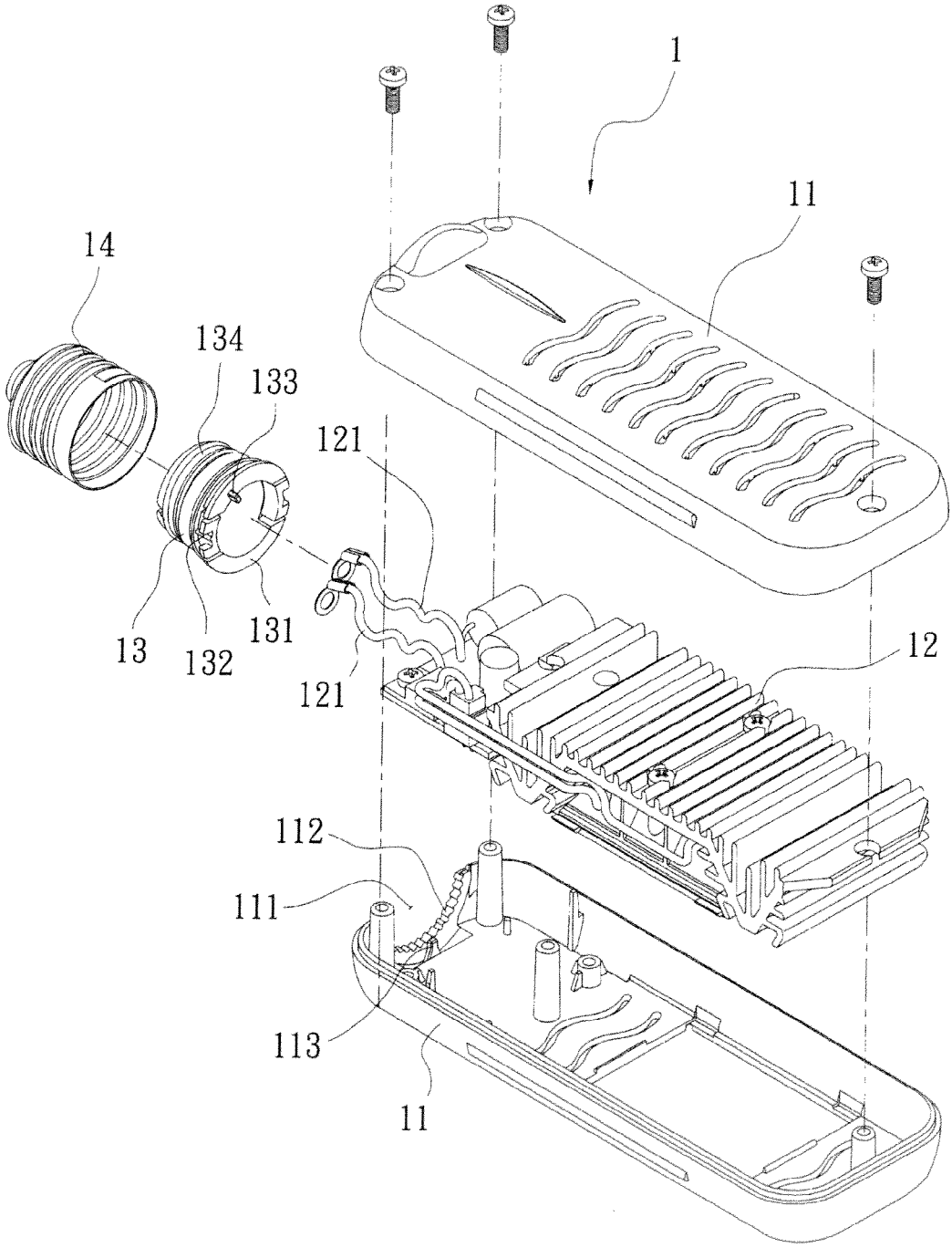
FIG. 1 is an explosive view of an embodiment according to the present invention.

Refer to FIG. 1, a LED lighting fixture 1 of the present invention includes lighting components 12 mounted in a housing 11. A connection hole 111 is mounted on one end of the housing 11. Cables 121 of the lighting components 12 pass through the connection hole 111. A plurality of positioning teeth 112 is formed on an inner edge of the connection hole 111 and a stopping convex part 113 is arranged at an inner side of the connection hole 111. A rotating shaft sleeve 13 is mounted in the connection hole 111 and including a stop flange 131 disposed on an inner end thereof. The stop flange 131 of the rotating shaft sleeve 13 is against the inner side of the connection hole 111. Moreover, positioning teeth 132 corresponding to the positioning teeth 112 on the inner edge of the connection hole 111 are disposed on the inner side of the stop flange 131 while a stopping convex part 133 corresponding to the stopping convex part 113 of the connection hole 111 is arranged at the outer side of the stop flange 131. A threaded segment 134 threaded with a terminal block 14 for connection and positioning is on an outer edge of the rotating shaft sleeve 13

Figure 2:
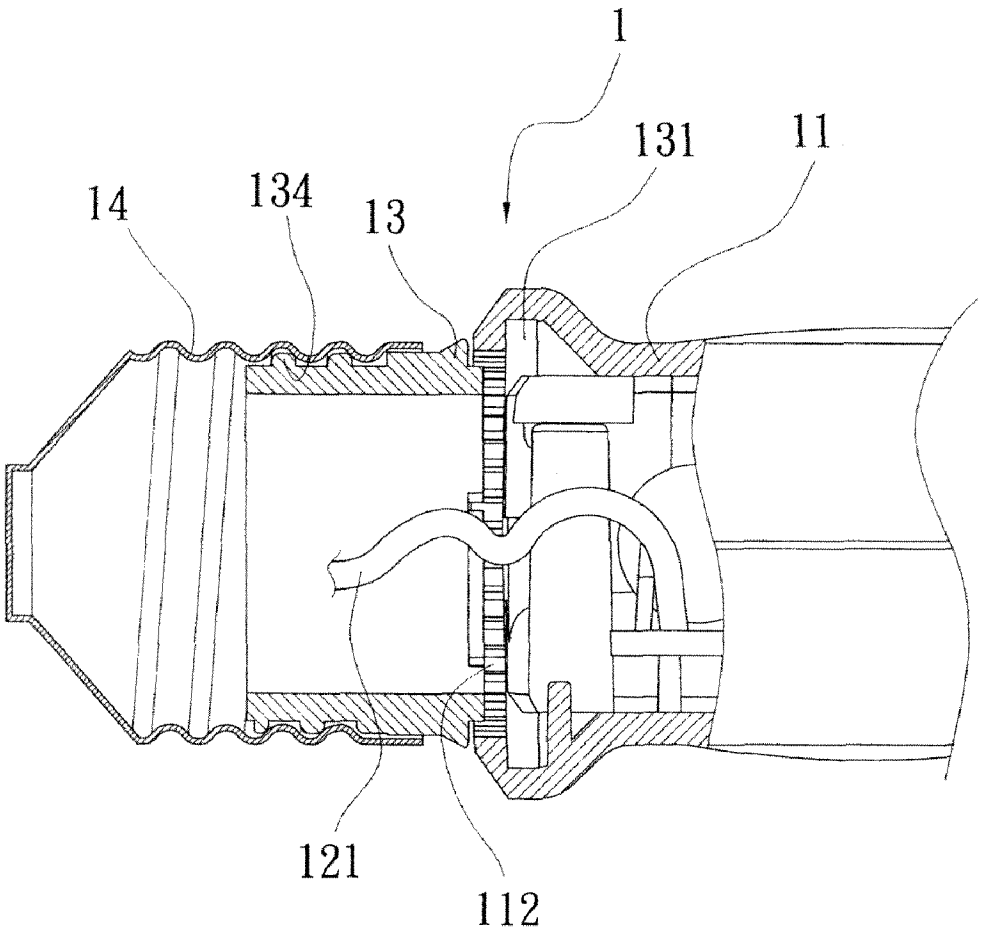
FIG. 2 is a partial enlarged cross sectional view of an assembled embodiment according to the present invention.
Figure 3:
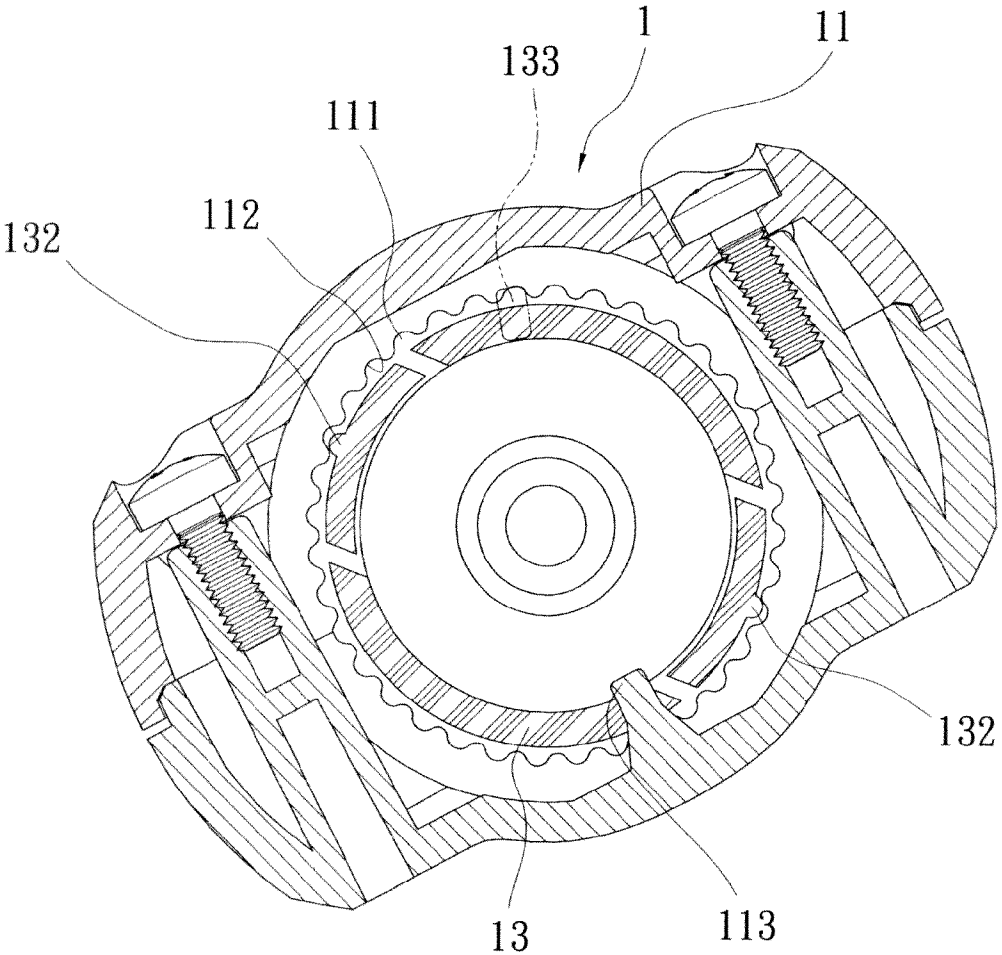
FIG. 3 is a front cross sectional view of an assembled embodiment according to the present invention.

During the assembling and connection, refer to FIG. 2 and FIG. 3, the lighting components 12 are set in the housing 11 of the LED lighting fixture 1 and the rotating shaft sleeve 13 is mounted into the connection hole 111 of the housing 11. The terminal block 14 is threaded and connected with the threaded segment 134 on the outer edge of the rotating shaft sleeve 13 for positioning. Now the cables 121 of the lighting components 12 pass through the rotating shaft sleeve 13 to be electrically connected with the terminal block 14. The positioning teeth 132 of the rotating shaft sleeve 13 is locked with the positioning teeth 112 on the inner edge of the connection hole 111 for positioning so as to prevent the housing 11, the rotating shaft sleeve 13 and the terminal block 14 from rotating freely.

Figure 4:
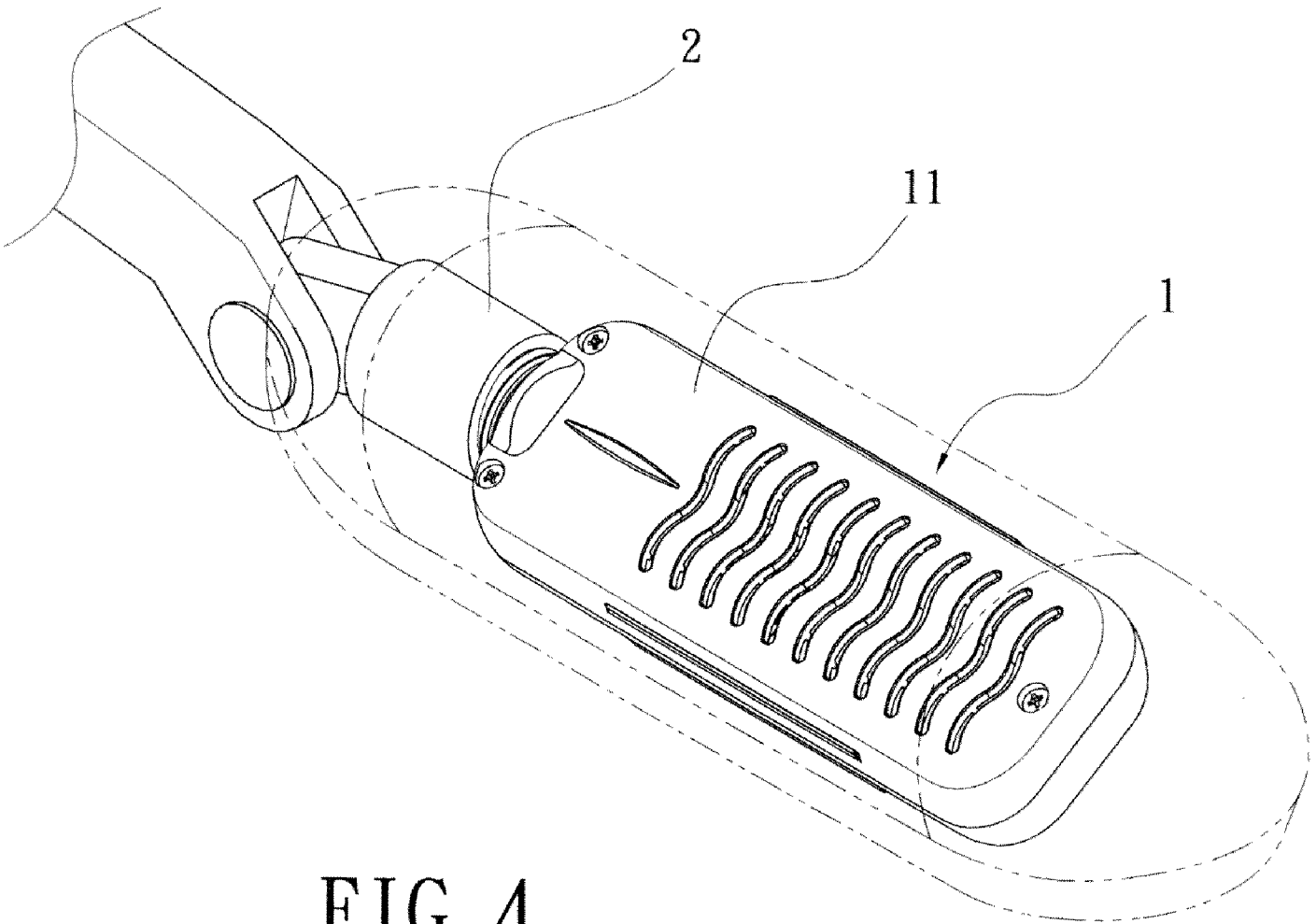
FIG. 4 is a perspective view of an embodiment according to the present invention.
Figure 5:
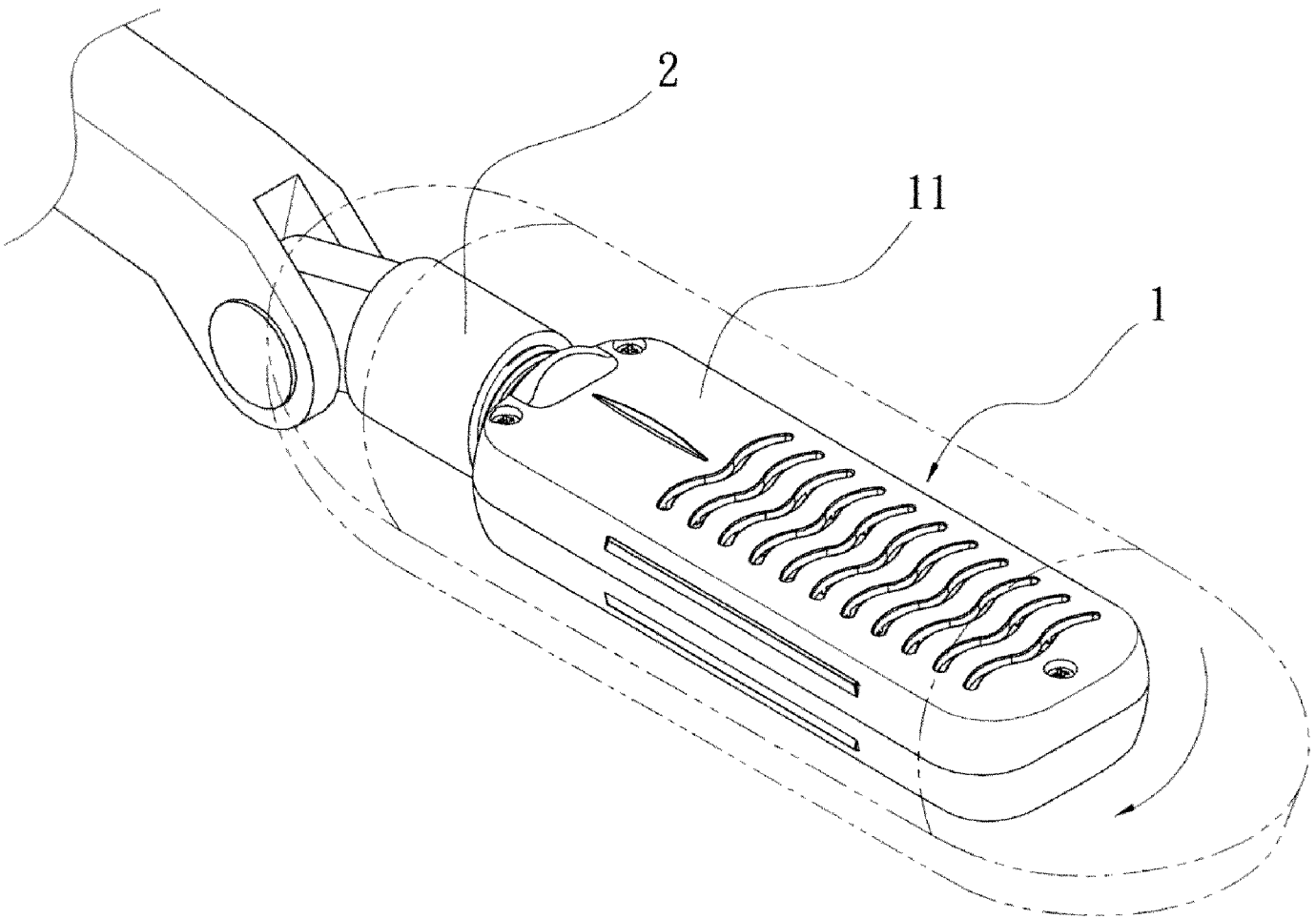
FIG. 5 is a perspective view of an embodiment while being rotated according to the present invention.
Figure 6:
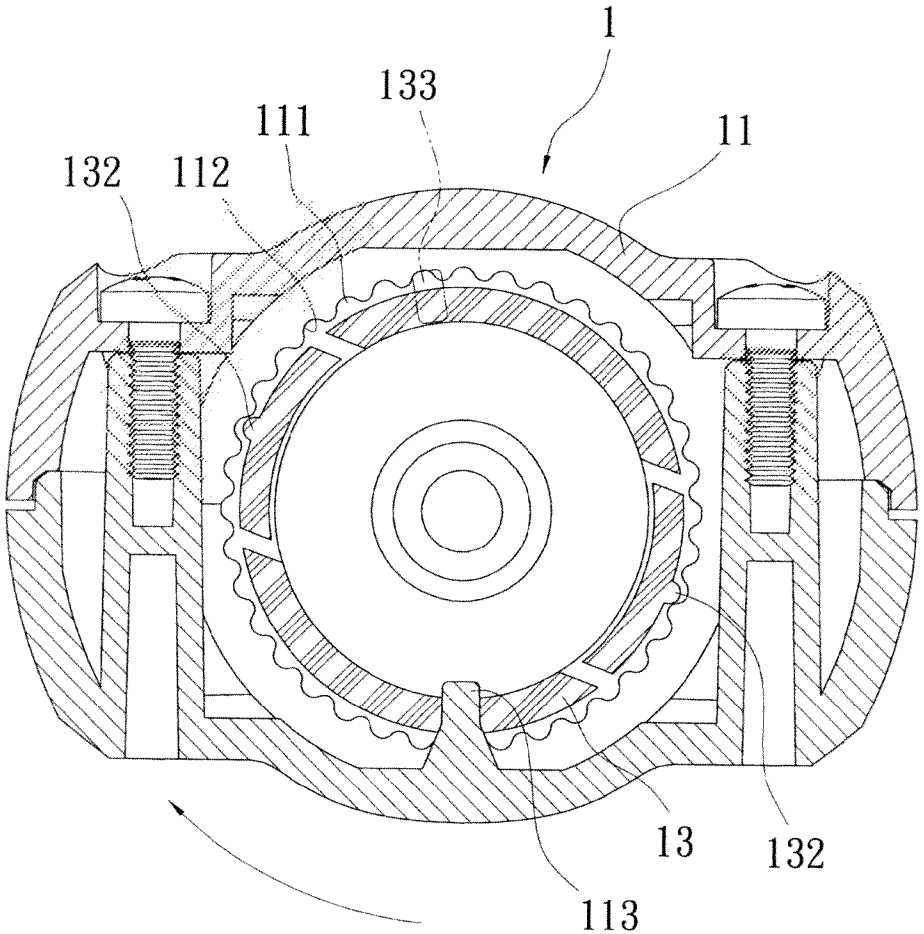
FIG. 6 is a front cross sectional view of an assembled embodiment in the rotation according to the present invention.

Refer to FIG. 4, after the terminal block 14 of the LED lighting fixture 1 being connected and threaded with a light holder 2, the direction of a light emitting surface of the lighting components 12 of the LED lighting fixture 1 can be adjusted once the light emitting surface doesn't face the required position. Also refer to FIG. 5 and FIG. 6, the housing 11 of the LED lighting fixture 1 is rotated directly. Then the rotation between the housing 11 and the rotating shaft sleeve 13 occurs. By the positioning teeth 112 on the inner edge of the connection hole 111 and the positioning teeth 132 of the rotating shaft sleeve 13 engaged and locked with each other during the rotation, the housing 11 is rotated, adjusted, stopped and positioned around the terminal block 14 that is connected and threaded with the outer edge of the threaded segment 134 of the rotating shaft sleeve 13. Thus the angle of the light emitting surface of the lighting components 12 in the housing 11 is changed.

Figure 7:
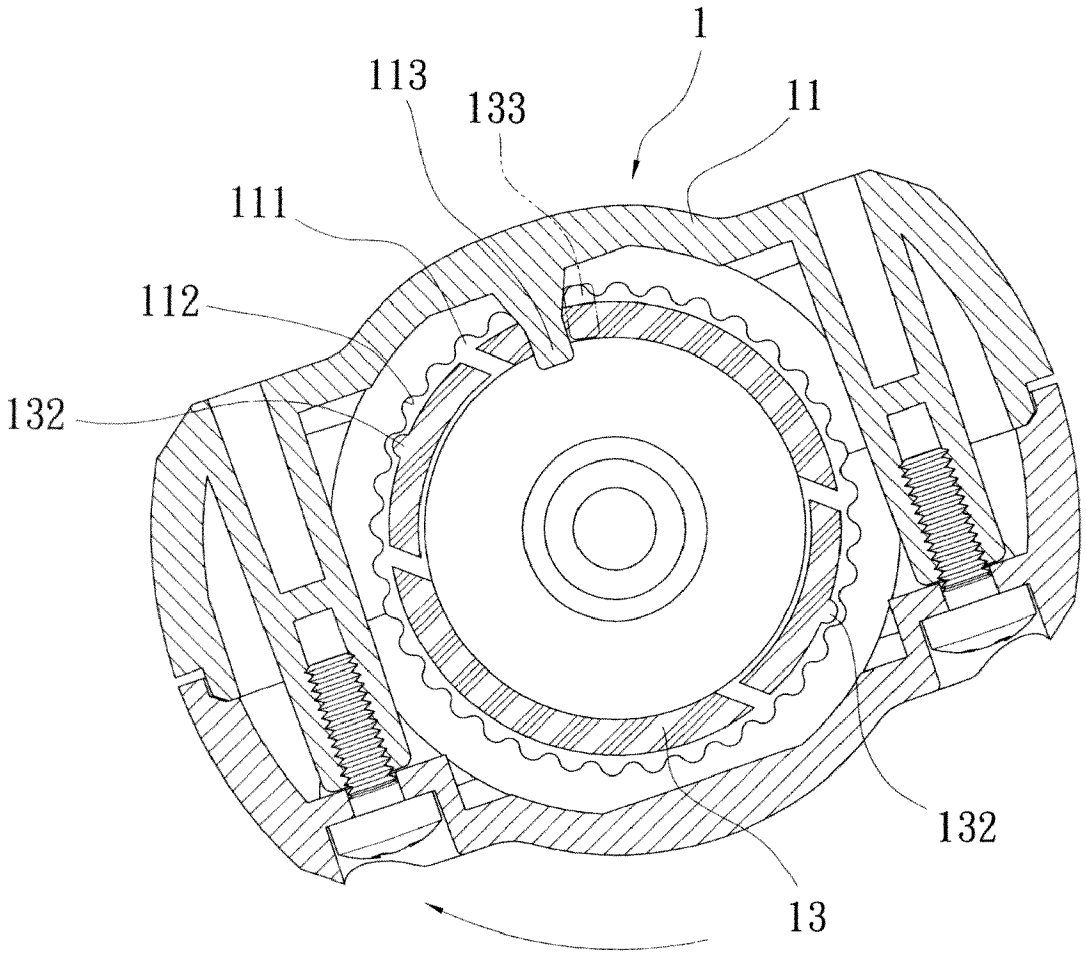
FIG. 7 is a front cross sectional view of an assembled embodiment in the stopped state according to the present invention.

Refer to FIG. 7, in order to prevent the cables 121 of the lighting components 12 passed through the rotating shaft sleeve 13 and electrically connected with the terminal block 14 from getting tangled and wound during the rotation of the housing 11 of the LED lighting fixture 1, the housing 11 is unable to be rotated further when the stopping convex part 113 at the inner side of the connection hole 111 of the housing 11 is rotated to against the stopping convex part 133 of the rotating shaft sleeve 13 correspondingly. The housing 11 now can only be rotated in the opposite direction. Thus the housing 11 will not be rotated toward the same direction continuingly and the tangling of the cables 121 of the lighting components 12 can be avoided.

In summary, compared with the structure available now, the housing of the present invention can be rotated directly. Then the rotation between the housing and the rotating shaft sleeve occurs. By the positioning teeth of the housing and the positioning teeth of the rotating shaft sleeve engaged and locked with each other during the rotation, the housing is rotated and adjusted around the terminal block threaded with the outer edge of the threaded segment of the rotating shaft sleeve. Thus the angle of the light emitting surface of the lighting components in the housing is changed. And the present invention is of a higher practical value in applications.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A LED lighting fixture with a rotating terminal block comprising:

at least one lighting component mounted in a housing;

at least one connection hole set on one end of the housing and being passed through by at least one cable of the lighting component;

a plurality of positioning teeth arranged at an inner edge of the connection hole;

at least one rotating shaft sleeve mounted in the connection hole and having a stop flange disposed on an inner end thereof while the stop flange against an inner side of the connection hole;

a plurality of positioning teeth corresponding to the positioning teeth on the inner edge of the connection hole and disposed on an inner side of the stop flange; and at least one threaded segment formed on an outer edge of the rotating shaft sleeve and threaded with at least one terminal block for connection and positioning.

2. The device as claimed in claim 1, wherein at least one stopping convex part is arranged at the inner side of the connection hole of the housing and at least one stopping convex part corresponding to the stopping convex part of the connection hole is disposed on the stop flange.

* * * * *